US009172183B2

(12) United States Patent
Siwek et al.

(10) Patent No.: US 9,172,183 B2
(45) Date of Patent: Oct. 27, 2015

(54) CONNECTOR ASSEMBLY WITH SPRING OPERATED SECONDARY LOCK

(71) Applicant: DELPHI TECHNOLOGIES, INC., Troy, MI (US)

(72) Inventors: Bartlomiej Siwek, Cracow (PL); Pawel Lesniak, Tarnow (PL)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 14/330,217

(22) Filed: Jul. 14, 2014

(65) Prior Publication Data

US 2015/0056841 A1 Feb. 26, 2015

(30) Foreign Application Priority Data

Aug. 20, 2013 (EP) ..... 13181082

(51) Int. Cl.
*H01R 13/627* (2006.01)
*H01R 13/639* (2006.01)

(52) U.S. Cl.
CPC ..... *H01R 13/6271* (2013.01); *H01R 13/6273* (2013.01); *H01R 13/639* (2013.01)

(58) Field of Classification Search
USPC ..... 439/352, 350, 345, 489; 200/535
See application file for complete search history.

(56) References Cited

U.S. PATENT DOCUMENTS 7,238,039 B2 7/2007 Holweg

FOREIGN PATENT DOCUMENTS

EP 1540778 B1 5/2007
EP 1207591 B1 5/2010

*Primary Examiner* — Alexander Gilman
(74) *Attorney, Agent, or Firm* — Robert J. Myers

(57) ABSTRACT

The present invention relates to an electrical connector assembly comprising a plug connector and a spring operated secondary lock, being arranged movable on the plug connector housing between an open position and a locked position. The connector is further provided with tension springs, which are tensioned when the secondary lock is moved from the locked to the open position.

12 Claims, 5 Drawing Sheets

CONNECTOR ASSEMBLY WITH SPRING OPERATED SECONDARY LOCK

CROSS-REFERENCE TO RELATED APPLICATION

This application claims the benefit under 35 U.S.C. §119 (a) of European Patent Application EP 13181082.2, filed on Aug. 20, 2013, the entire disclosure of which is hereby incorporated by reference.

TECHNICAL FIELD OF THE INVENTION

The present invention relates to an electrical connector assembly comprising a plug connector and a spring operated secondary lock assigned thereto.

BACKGROUND OF THE INVENTION

In many applications, the safe coupling of connectors is of high importance. For example, in the case of car safety systems, as for example airbag systems in passenger cars, the connectors used for the connection of an airbag to its ignition base have to be provided with reliable safety mechanisms. To ensure that the connectors cannot become loose unintentionally, secondary locking members are known to guarantee a safe mechanical coupling.

A typical example of an airbag squib connector provided with a secondary locking member is known from EP 1 207 591 B1. In this publication, an airbag plug connector is described comprising a plug connector housing with a plug in portion, which is adapted to be plugged into the corresponding receptacle of an airbag igniter or airbag squib. The plug part of the connector comprises a pair of locking arms, which are adapted to latch into a corresponding latching groove provided in the counter connector. To secure this latch type connection, the connector does further comprise a secondary locking member, also often denoted as connector position assurance device (CPA). This secondary lock is arranged moveable on the plug connector housing in mating direction of the plug connector between an open and a locked or closed position. In the open position, the secondary locking member projects to some extent from the upper surface of the plug connector and in this open position it is possible to mate the plug connector with the corresponding counter connector. After the mating process is complete, the secondary lock can be moved manually into the locked or closed position. In this locked position, locking legs provided on the secondary locking member prevent a release movement of the locking arms of the plug connector. From this prior art document it is also known to provide the secondary locking member with a mechanism, that prevents that the secondary member can be put into the locked position, if no counter connector is present, i.e. when the plug connector is not mated. This mechanism utilizes a spring arm with a step, which rests on a protrusion of the plug connector housing and prevents that the secondary lock can be brought into the locked position. Upon mating with the counter connector, this spring arm is deflected by a portion of the counter connector, so that upon full mating it is possible to move the secondary lock into the locked position, thereby securing the mated condition of the two connectors.

To facilitate the assembly of such plug connectors having secondary locking systems, spring actuated secondary locking mechanisms were developed. EP 1 540 778 B1 describes for example a plug-in connector comprising a secondary locking mechanism impinged by a spring force. In this publication a plug-in connector for airbag restraint systems is suggested, which comprises a secondary locking mechanism and four compression or pressure springs. The pressure springs are arranged, such that upon mating of the plug connector with the corresponding counter connector, the secondary lock is moved by the counter connector from the locked position to the open position against the pressure forces of the springs. At the end of the mating process, the secondary lock is suddenly released, and the four springs press the secondary lock back into the closed or locked position, thereby securing the mating process automatically.

The construction of this connector works very well, however, the skilled person is always trying to find improvements. It would be in particular desirable, to achieve a spring operated secondary locking mechanism, which is more compact in design and which is easier to assemble. The choice of pressure springs as in the prior art requires suitable guiding structures in the connector housing, since the compressed spring requires a spring buckling prevention. Further, since the pressure springs are loosely arranged in the corresponding guide structure, a risk exists, that these loose parts get lost during assembly and it is difficult to integrate the mounting of the springs in a fully automated assembly process.

BRIEF SUMMARY OF THE INVENTION

It is therefore an object of the present invention to provide an electrical connector assembly with a plug connector and a spring operated secondary lock, which is of robust and simple construction and which at the same time provides a safe and automatic activation of the secondary locking mechanism. It is a further object of the invention to provide such a connector assembly, respectively plug connector, which has a compact design and is less susceptible to failure.

According to the present invention, an electrical connector assembly is provided which comprises a plug connector including a plug connector housing with a plug-in portion. A spring operated secondary locking member is assigned to the plug connector and is arranged thereon moveable between an open position and a locked or closed position. The direction of movement is generally preferred the mating direction of the plug connector, i.e. the secondary lock can be moved back and forth in mating direction. The assembly preferably further comprises at least one tension spring, most preferably two symmetrically arranged tension springs. The tension spring(s) are attached at a spring attachment portion of the secondary lock on the one end and at a spring attachment portion provided on the plug connector housing next to the plug in portion on its other end. The spring attachment portion of the secondary lock is provided at its far end relative to the plug-in portion. Due to this arrangement of the tension spring the same is tensioned when the secondary lock is moved from the locked to the open position. Thus, preferably, in the initial configuration, the secondary lock is in the closed or locked position, and upon mating the plug connector with a corresponding counter connector, the secondary lock is moved, e.g. due to a contact with the counter connector, from the locked to the open position. At the end of the mating process, the secondary lock is released and thus automatically moved due to the tensioned springs from the open position to the locked position, thereby securing the mating of the two connectors.

Generally preferred, the plug-in portion comprises at least two latching arms for latching with corresponding latching means of the counter connector, as for example corresponding latching grooves. Further, likewise generally preferred, the secondary lock comprises locking means, as for example blocking legs, which are adapted to block a release movement of the latching arms when the secondary lock is in the locked position. Thereby, the secondary lock fulfills its "secondary" locking function. Preferably, the secondary lock is provided with some kind of locking means, which hold or latch the secondary lock in the locked position, to prevent an unintentional opening of the secondary locking device.

In contrast to the above discussed prior art, the tension spring is preferably attached on both its opposite ends at a corresponding attachment portion of the secondary lock and a corresponding attachment portion of the plug connector housing, respectively. Thereby, upon relative movement of the secondary lock and the plug connector housing (i.e. as initiated during a mating process due to a contact of the secondary lock with a portion of the counter connector) the tension spring will be biased or tensioned and generally provides bias to pull the secondary lock back into the closed position. In a particularly preferred embodiment, the tension spring comprises attachment loops on both of its opposite ends which are integrally formed from the spring wire of the tension springs. Accordingly, likewise preferred, also the attachment portions of secondary lock and plug connector housing are generally cylindrical portions extending in a plane perpendicular to the mating direction and are formed, such that the attachment loops of the tension spring fits snugly over the cylindrical portion, whereby a fully automated assembly process is achievable.

In a preferred embodiment, the plug connector housing comprises or essentially consists of a main part with the plug-in portion and a cover part and the tension spring is attached to the main part and the cover is adapted to prevent the spring from getting separated from the main part. To this end, it is preferred that the spring is completely surrounded by the cover part.

A suitable tension spring comprises preferably at least 5 coils, more preferably at least 8 coils and most preferably at least 10 coils.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
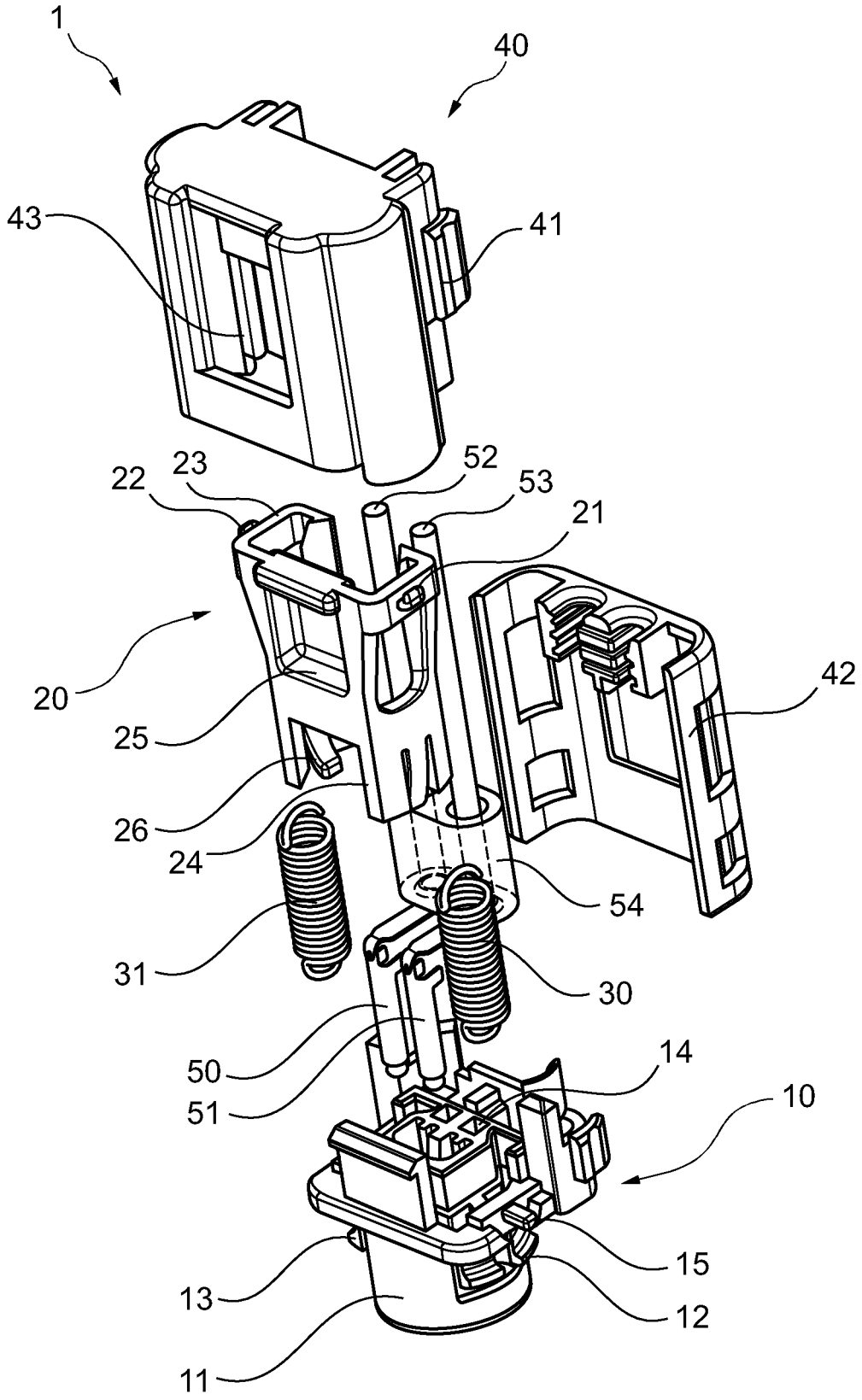
FIG. 1 shows a connector assembly in accordance with the invention in an exploded three-dimensional view.

FIG. 1 shows an electrical connector assembly 1 in accordance with the invention in an exploded schematic three-dimensional view. The shown connector is an airbag squib connector and comprises a main part 10 with a plug-in portion 11. The plug-in portion 11 comprises two latching arms 12, 13, being arranged on opposite sides of the plug-in portion 11. The latching arms 12, 13 serve for latching with corresponding latching means of a counter connector 80. The counter connector 80 itself can be a standard part, e.g. as described in the initially discussed prior art. The main part 10 comprises a cavity 14 for the reception of electrical contact terminals 50, 51. The contact terminals 50, 51 are connected with signal cables 52, 53 and a ferrite element 54 is additionally provided as electromagnetic shielding. Further, the main part 10 comprises an attachment portion 15 which will be described in more detail below. The connector housing is supplemented by a cover 40, which is in the shown preferred embodiment divided in two halves 41, 42 that can be connected by latch-type connection means. The cover 40 further comprises an opening 43 arranged therein, which allows an engagement of the secondary lock 20 for manual release thereof, as will be described in more detail below.

A spring operated secondary lock 20 is further provided, which in assembled condition is moveable on, respectively in, the plug connector housing in mating direction between an open position and a locked position. The spring operation is achieved by means of two tension springs 30, 31. In order to transfer the tension force of the tension springs 30, 31 between main part 10 and secondary lock 20, the secondary lock 20 comprises attachment portions 21, 22, whereby each tension spring 30, 31 is attached with its upper end (as seen in FIG. 1; in practice the connector assembly can be used in any spatial orientation) at attachment portions 21, 22 of the secondary lock 20 and the lower ends of the tension springs 30, 31 are attached at attachment portions 15, 16 (see FIG. 3) of the main part 10, so that the tension springs 30, 31 are tensioned, when the secondary lock 20 is moved from the locked to the open position. The attachment portions 21, 22 are arranged at the far end of secondary lock 20 relative to the plug-in portion 11 and the attachment portions 15, 16 of the main part 10 are arranged next to the plug-in portion 11. In this way, a particular compact design is achieved. The secondary lock 20 comprises two opposing side walls 23, 24, extending in mating direction and plate portion 25, which connects the two sidewalls with each other. Thus, the cross-section of the secondary lock 20 cut through a plane perpendicular to the mating direction is essentially U-shaped or C-shaped.

Figure 2:
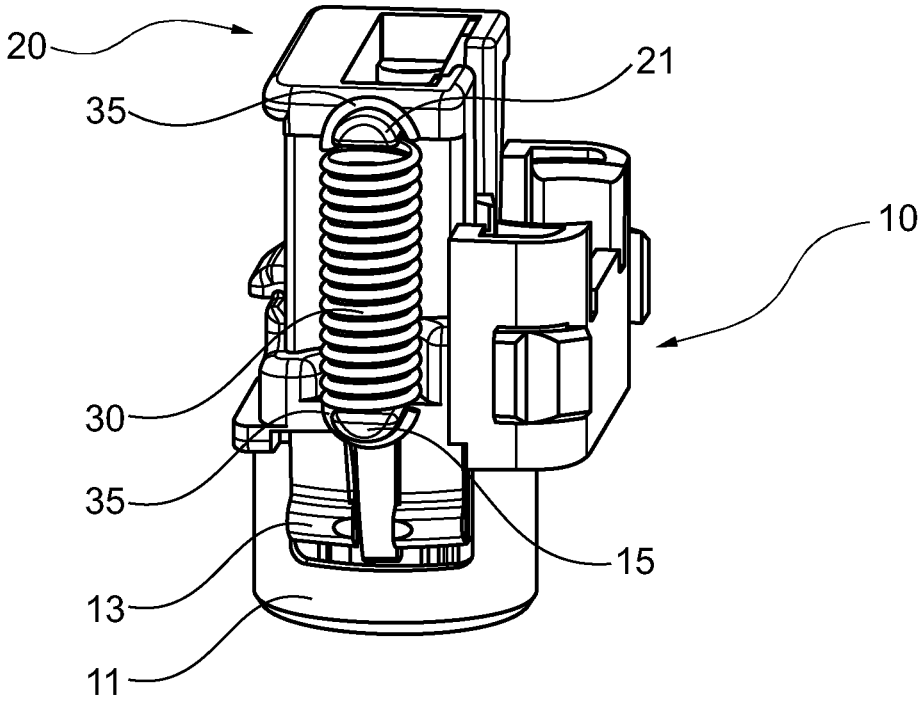
FIG. 2 shows the connector of FIG. 1 in partially assembled condition.
Figure 3:
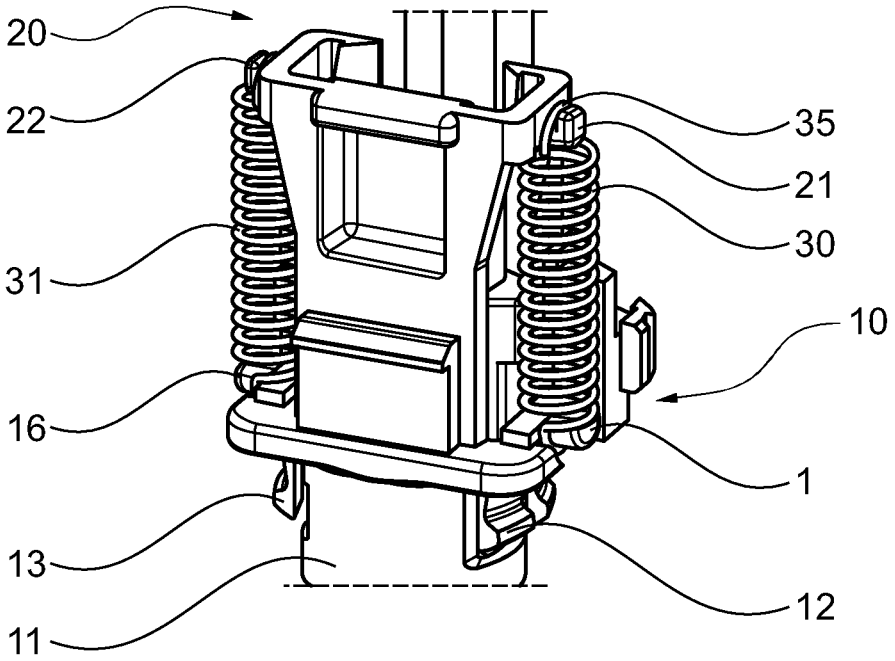
FIG. 3 shows the same assembly status as FIG. 2 from a different perspective.

Now turning to the illustrations of FIGS. 2 and 3, which show the secondary lock 20 assembled with the main part 10, and the tension springs 30, 31 attached to the respective attachment portions 15. As one can take from the figures, secondary lock 20 is partially arranged inside of main part 10. The tension springs 30, 31 are attached to the main part 10, respectively the secondary lock 20, by means of attachment loops 35 at opposite ends of the tension springs 30, 31, which loops are integrally formed from the spring wire. The attachment portions 15, 16, 21, 22 (see FIG. 3) shown are cylindrical and extend in a plane perpendicular to the mating direction. In FIG. 2, the tension springs 30, 31 are already biased to some extent and the secondary lock 20 is shown in a position between the locked and open position. In FIG. 3, the secondary lock 20 is shown in the open position and the tension springs 30, 31 are now stretched and bias secondary lock 20 back into the locked position. In the situation of FIG. 3, the blocking arms 26 of the secondary lock 20 (in FIG. 1 only one of the blocking arms 26 is shown, the other blocking arm is arranged symmetrically at the opposite side next to side wall 24), rest on a corresponding portion of the counter connector (not shown) and when the plug connector 1 is almost fully mated, the secondary lock 20 is in the open position as shown in FIG. 3. At that instance, i.e. upon fully mated or shortly before the fully mated position is achieved, the blocking arms 26 of the secondary lock 20 are released by a suitable release portion provided on the main part 10, and the secondary lock 20 snaps back into the locked position by means of the tensioned springs 30, 31. In other words, the tension springs 30, 31 automatically move the connector position assurance device (CPA) in the locked position. The spring force acts exactly on the connector symmetry axis and, as the CPA latches, no buckling momentum acts on the CPA and the friction between CPA and its guide structure in the connector housing is very low compared to the prior art solutions. The release mechanism can be similar as the one of the EP 1 207 591 B1 discussed above, however, with the present invention, the release portion is preferably a part of the plug connector 1 and not of the counter connector 80.

In FIG. 2, one can further see how the lower ends of the side walls 23, 24 are arranged behind the latching arms 12, 13, so that the latching arms 12, 13 cannot be moved inwardly toward the plug-in portion 11 and are thus blocked. In fully mated condition, these latching arms 12, 13 latch into for example a corresponding annular groove 83 of the counter connector 80 and since in the locked position of the secondary lock 20 an inward movement of the latching arms 12, 13 is prevented by the side walls 23, 24, it is no longer possible to unmate connector and counter connector 80. In other words; the side walls 23, 24, respectively the lower ends thereof, are blocking legs to block a release movement of the latching arms 12, 13.

Figure 4:
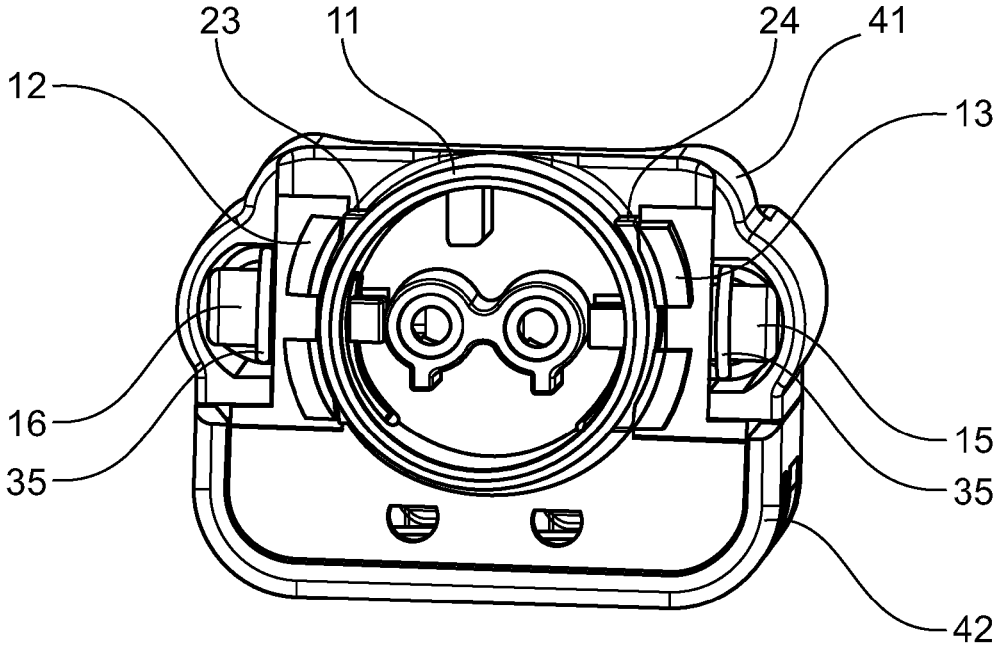
FIG. 4 shows the connector in assembled condition from the bottom.

FIG. 4 shows the plug connector 1 in assembled condition from the bottom side. From this perspective, one can clearly see that the latching arms 12, 13 are integrally formed with the main part 10 and that the lower portions of side walls 23, 24 are arranged between the latching arms 12, 13 and the plug-in portion 11.

Figure 5:
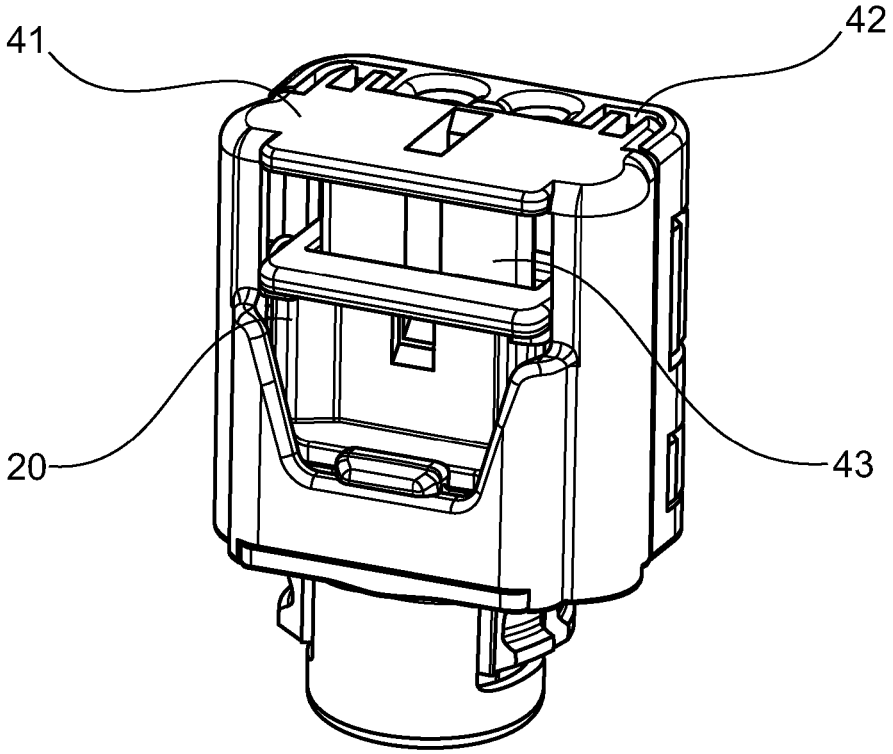
FIG. 5 shows a schematic three-dimensional view of the assembled connector with the secondary lock in the locked position.

In FIG. 5, one can see how the opening 43 provided in connector half 41 allows an engagement of the secondary lock 20 for a release of the secondary lock 20. Thus, to unmate the plug connector 1 and counter connector 80, one has to first move secondary lock 20 into the open position shown in FIG. 3.

Figure 6:
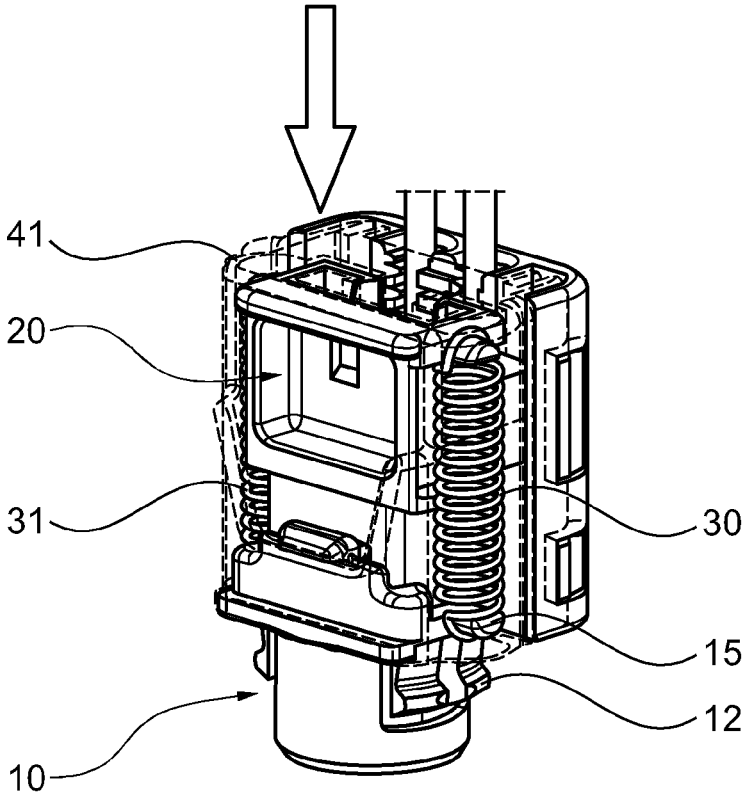
FIG. 6 is a partially cut schematic view showing details of the interior of the connector in assembled condition.
Figure 7:
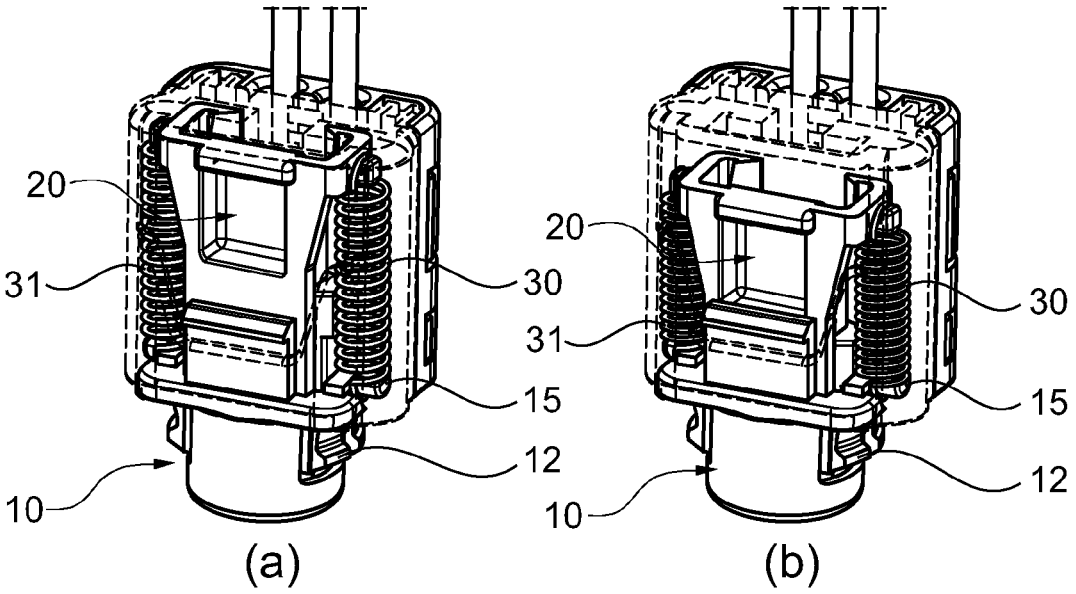
FIGS. 7*a* and *b* show the locking process of the secondary lock.

In FIGS. 6 to 7 the plug connector 1 is shown in assembled condition, however, the connector half 41 is partially transparent to allow a discussion of the interior parts of the connector. The connector halves are adapted to fully enclose the secondary lock 20. In FIG. 6, the secondary lock 20 is in the fully open position and the tension springs 30, 31 are tensioned. The secondary lock 20 is moved into this open position due to a contact of a suitable actuating portion, which is adapted to be engaged by the counter connector 80 during the mating process of the plug connector 1 with the counter connector 80. Due to this actuating portion—which is in the shown embodiment constituted by the lower end of blocking arms 26—upon inserting of the plug connector 1 into the counter connector 80, the secondary lock 20 rests on a face or portion of the counter connector 80 and is thereby moved upwardly relative to the main part 10 of the plug connector 1. When the plug connector 1 finally reaches the fully mated position, a corresponding release portion of main part 10 (not shown in the figures) will release the blocking arms 26 from the counter connector 80, so that the tensioned springs 30, 31 will automatically pull the secondary lock 20 into the closed position as shown in FIG. 7*b*.

Figure 8:
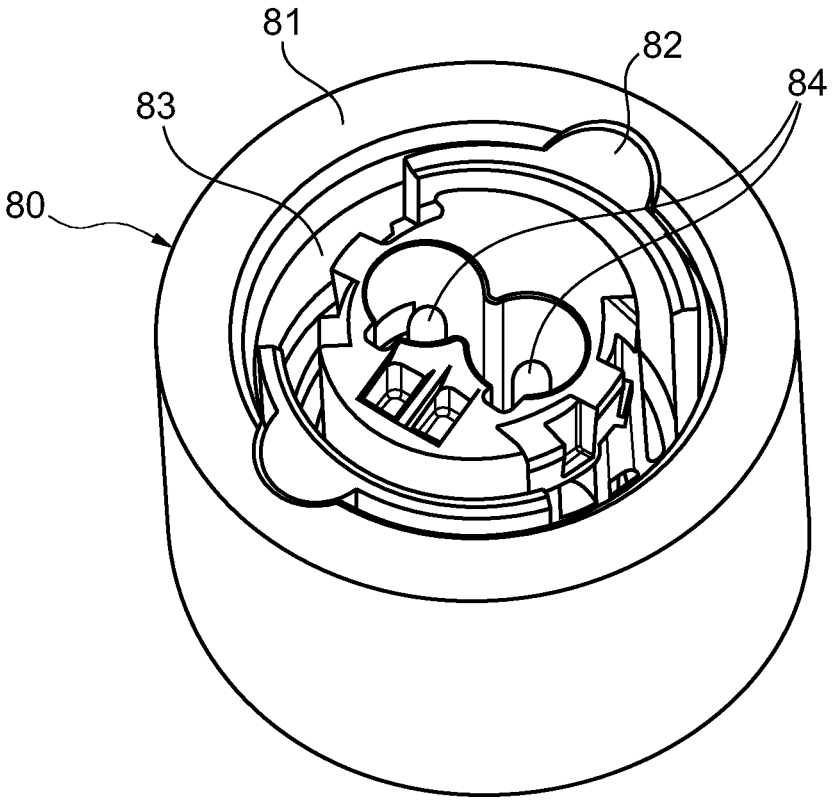
FIG. 8 shows a schematic three-dimensional view of corresponding counter connector.

FIG. 8 shows a schematic three-dimensional view of a corresponding counter connector 80. As the skilled person recognizes, the counter connector 80 is formed by a receptacle 81 of an airbag squib connector and a retainer insert 82. The inner walls of the receptacle 81 comprise an annular groove 83 adapted to allow a latching of the latching arms 12, 13 of the plug connector 1. Further, the counter connector 80 comprises two contact pins 84 adapted to establish electrical contact with the terminals 50, 51 of the plug connector 1 in mated condition.

The inventive construction allows a very compact design and is at the same time very robust and simple to manufacture. Since the tension springs 30, 31 are attached to secondary lock 20 and connector housing they do not become unintentionally loose and they do not need any guide structure to prevent them from buckling, as it was necessary in the prior art. Further, the invention allows a construction where the spring force acts exactly on the connector symmetry axis so that no buckling momentum acts on the CPA. Further, thereby, the friction between CPA and its guide structure in the connector housing is very low compared to the prior art solutions.

The invention claimed is:

1. An electrical connector assembly, comprising:

a plug connector including a plug connector housing having a plug-in portion;

a corresponding counter connector;

a spring operated secondary lock moveably arranged on the plug connector housing in a mating direction of the plug connector between an open position and a locked position; and a tension spring, wherein the secondary lock comprises a first spring attachment portion for the tension spring at its far end relative to the plug-in portion, wherein the plug connector housing comprises a second spring attachment portion next to the plug-in portion, wherein the tension spring is attached with its respective ends at these respective spring attachment portions such that the tension spring is in tension when the secondary lock is moved from the locked to the open position, wherein the secondary lock further comprises an actuating portion configured to be engaged by the counter connector during a mating process of the plug connector with the counter connector, so that the secondary lock is moved from the locked position to the open position upon mating, and wherein the engagement of the actuating portion with the counter connector is released at the end of the mating process, such that the tension spring will pull the secondary lock back into the locked position.

2. The electrical connector assembly according to claim 1, wherein the plug in portion comprises at least two latching arms for latching with corresponding latching means of the counter connector.

3. The electrical connector assembly according to claim 2, wherein the secondary lock comprises blocking legs configured to block a release movement of one of the at least two latching arms when the secondary lock is in the locked position.

4. The electrical connector assembly according to claim 1, wherein the tension spring comprises attachment loops on both opposite ends being integrally formed by said tension spring.

5. The electrical connector assembly according to claim 4, wherein the attachment loops are cylindrical portions extending in a plane perpendicular to the mating direction.

6. The electrical connector assembly according to claim 1, wherein the plug connector housing comprises a main part and a cover part and the tension spring is attached to the main part and the cover part is configured to prevent the tension spring from getting separated from the main part.

7. The electrical connector assembly according to claim 1, wherein the tension spring comprises at least 5 coils.

8. The electrical connector assembly according to claim 1, wherein the secondary lock has two opposing side walls extending in mating direction and a plate portion connecting the two side walls.

9. The electrical connector assembly according to claim 1, wherein the plug connector housing comprises a cover having an opening arranged therein which allows an engagement of the secondary lock for a manual release of the secondary lock.

10. The electrical connector assembly according to claim 9, wherein the cover consists of two halves which fully enclose the secondary lock.

11. The electrical connector assembly according to claim 1, wherein the actuating portion of the secondary lock comprises two actuating arms extending in mating direction, said actuating arms are engaged by the counter connector upon mating, so that the secondary lock is moved from the locked position to the open position upon mating; and the plug connector housing comprises a release portion, which releases the actuating arms from the counter connector at the end of the mating process.

12. The electrical connector assembly according to claim 1, wherein the plug connector is a 180° plug connector.

* * * * *